US007040066B2

(12) United States Patent
Fan

(10) Patent No.: US 7,040,066 B2
(45) **Date of Patent: *May 9, 2006**

(54) STRUCTURE FORMED OF FOAMING CEMENT AND LIGHTWEIGHT STEEL AND A STRUCTURAL SYSTEM AND METHOD OF FORMING THE STRUCTURAL SYSTEM

(76) Inventor: Zhi Fan, No. 4, East Two Tiao, Iiuo Shen Temple, Huang Chun Town, Daxing County, 102600 Beijing (CN)

( * ) Notice: Subject to any disclaimer, the term of this patent is extended or adjusted under 35 U.S.C. 154(b) by 17 days.

This patent is subject to a terminal disclaimer.

(21) Appl. No.: 10/889,845

(22) Filed: Jul. 12, 2004

(65) Prior Publication Data

US 2004/0255534 A1 Dec. 23, 2004

Related U.S. Application Data

(62) Division of application No. 10/018,146, filed as application No. PCT/CN00/00020 on Feb. 2, 2000, now Pat. No. 6,779,314.

(30) Foreign Application Priority Data

Jun. 14, 1999 (CN) ..... 99109102 A

(51) Int. Cl.
*E04B 1/14* (2006.01)
*E04C 2/34* (2006.01)

(52) U.S. Cl. ..... 52/309.12; 52/309.7; 52/414; 52/396.02; 52/583.1

(58) Field of Classification Search ..... 52/309.7, 52/309.9, 309.12, 414, 454, 474, 481.1, 483.1, 52/561, 583.1, 586.1, 783.18, 798.1, 742.14, 52/309.2, 309.11, 396.02; 428/312.4, 158
See application file for complete search history.

(56) References Cited

U.S. PATENT DOCUMENTS

| | | | | | |
|---|---|---|---|---|---|
| 792,593 | A | * | 6/1905 | Himmelwright | 52/414 |
| 867,251 | A | * | 10/1907 | Davis | 52/354 |
| 2,047,145 | A | * | 7/1936 | Klein | 52/242 |
| 2,241,338 | A | * | 5/1941 | Balduf | 52/241 |
| 3,953,954 | A | * | 5/1976 | Leone | 52/737.6 |
| 4,042,745 | A | * | 8/1977 | Cornwell et al. | 428/138 |
| 4,866,897 | A | * | 9/1989 | Yount | 52/363 |
| 5,112,678 | A | * | 5/1992 | Gay et al. | 442/173 |
| 5,233,810 | A | * | 8/1993 | Jennings | 52/745.19 |
| 5,414,972 | A | * | 5/1995 | Ruiz et al. | 52/600 |
| 5,505,031 | A | * | 4/1996 | Heydon | 52/281 |
| 5,647,180 | A | * | 7/1997 | Billings et al. | 52/268 |
| 5,741,357 | A | * | 4/1998 | Sheikh | 106/692 |
| 5,809,724 | A | * | 9/1998 | Bodnar | 52/414 |
| 6,151,858 | A | * | 11/2000 | Ruiz et al. | 52/481.1 |

(Continued)

FOREIGN PATENT DOCUMENTS

| | | | | |
|---|---|---|---|---|
| EP | 741212 | * | 6/1996 | 52/414 |

(Continued)

*Primary Examiner*—Winnie Yip

(57) ABSTRACT

A foaming cement (1), cooperates with the steel member (5), forms the fender structure (111), which could solely resist the load in horizontal or vertical direction, or cooperate with the columniation (222). The whole lightweight steel (5) is embedded in the foaming cement or the floor slabs. The fender structure (111) cooperates with the roof board, the ceiling (555) and the various floor slabs (333) in forming the structural system, which is capable of preserving heat and bearing the load and beautifying the environment.

20 Claims, 20 Drawing Sheets

U.S. PATENT DOCUMENTS

| | | | | |
|---|---|---|---|---|
| 6,233,892 | B1 * | 5/2001 | Tylman | 52/309.12 |
| 6,263,628 | B1 * | 7/2001 | Griffin G. E. Steel Company | 52/309.12 |
| 6,401,417 | B1 * | 6/2002 | Leblang | 52/481.1 |
| 6,578,343 | B1 * | 6/2003 | Dumler et al. | 52/783.17 |

FOREIGN PATENT DOCUMENTS

| | | | | |
|---|---|---|---|---|
| JP | 9-4057 | * | 9/1997 | 52/414 |
| JP | 9-268647 | * | 9/1997 | 52/414 |
| WO | WO95/33106 | * | 12/1995 | 52/745.02 |

* cited by examiner

STRUCTURE FORMED OF FOAMING CEMENT AND LIGHTWEIGHT STEEL AND A STRUCTURAL SYSTEM AND METHOD OF FORMING THE STRUCTURAL SYSTEM

Cross-Reference to Related Application

This application is a divisional application, and claims priority benefit, of application Ser. No. 10/018,146 filed on Dec. 14, 2001 now U.S. Pat. No. 6,779,314 as a national stage application of PCT/CN00/00020, now allowed.

TECHNICAL FIELD

This invention, in art of construction, particularly relates to a steel structural system, which integrally combines steel frame with foaming cement, by embedding the former in the latter, to afford a structural system that resists fire, insulates heat, carries load and beautifies the environment.

BACKGROUND TECHNOLOGY

To date, steel structures are ready to erect and resistant to earthquake, with many merits for procedural, diversifying or industrialized production. However, the fender structures used in cooperation therewith are mostly made of such building materials as rolled steel sheets, gypsum rock wools or glass wool, so that the building structures formed thereby, especially in residential buildings, are poor in fire resistance, vulnerable to thermal bridge and costly in overall construction. Moreover, houses of the kind cannot render a comfortable feeling.

SUMMARY OF THE INVENTION

This invention is to provide a new type of foaming cement material, which integrally cooperates with steel frame to form a fender structure capable of bearing load in vertical or horizontal direction, either by the fender itself or by its combination with other building members through the lightweight steel frame being embedded in the foaming cement or between foaming cement boards/slabs. The fender structure, in cooperation with roof boards, ceilings and all types of floor slabs, forms a structural system that is capable of insulating heat, bearing load and beautifying the environment, comprising the followings:

This invention provides an A-type fender structure which, capable of carrying load solely by itself or by its combination with the main structural steel, possess the merits of fire resistance, load bearing, waterproof, heat insulation, beautiful decoration and ready erection. It is a kind of load-bearing structure with a shaped steel frame embedded in the foaming cement.

This invention provides a B-type fender structure which, capable of carrying load solely by itself or by its combination with the main structural steel, possess the sound merits of fire resistance, load bearing, waterproof, heat insulation, beautiful decoration and ready erection. It's made up of a load-bearing B1-type board formed by steel frame partially embedded in the foaming cement with its mating part B2-type of foaming cement without the framework.

This invention provides C-type boards as well as a C-type fender structure where the steel frame is sandwiched between the said two C-type boards. It is entailed not only the effectiveness of fire-resistance and durability, but also the merit of load bearing, heat insulation, sound absorption and environment beautification as well.

This invention provides an assembled lightweight partition wallboard which, capable of being assembled or disassembled freely on site, is tied together with roof boards and floor slab by screws.

This invention also provides a process for constructing buildings of different shape, which uses foaming cement as the basic material for fire resistance, heat insulation and decorative designs. Together with various steel frames and cement surface layers, it can offer a series of ready-in-use buildings of light weight and rich patterns, with good performance in strength, durability, fire resistance and thermal insulation.

Still another purpose of this invention is to provide a new method for house construction using lightweight steel structures and a variety of lightweight boards to add floors to old buildings or to reconstruct old residential houses into completely renewal ones with all facilitates thereof upgraded at the same time.

The Technical Solutions of this Invention Comprises:

A type of structural system formed of foaming cement and lightweight steel structure (steel frame), which is further divided into mid-low-rise and mid-high-rise building structural systems, wherein the former is made up of A, B, or C-type fender structure, floor slabs, decorative elements, ceilings and assembled partition wallboards, and the latter A, B, or C-type fender structure, steel columns, floor slabs, decorative elements, assembled partition wallboards and ceilings; said foaming cement used therein has a density of 150 kg/m$^3$–400 kg/m$^3$ and a thermal conductivity of 0.035–0.08 w/mk. It dose not need high-temperature steam curing, and is water impermeable (i.e. when dropping water on the surface of the foaming cement, water drop cannot penetrate through capillary into the foaming cement), and has airtight-cavity cellular structure (i.e. each cavity is separated from the others by walls thereof and thus every of them is isolated).

Of the fender structures, said A-type fender structure can either be formed on site with foaming cement or be assembled with pre-cast A-type board provided by manufacturers; said B-type fender structure is assembled on site with B1 and B2-type boards; and said C-type fender structure is formed of C1 and C2-type boards with steel frame sandwiched between them.

Said A, B, or C-type fender structure may be fastened mechanically to the steel skeleton of a building with steel frame embedded in the foaming cement. A, B, or C-type fender structure can be applied for walls and roofs.

Said foaming cement is made of dicalcium silicate, anhydrous calcium sulphoaluminate and sulphate dihydrate as main ingredients for gelatinizing, or by adding a given quantity of tricalcium silicate to form a compound, to mix with foaming agents and others modifying additives.

Said foaming cement may be added with an appropriate amount of fiber or organic resin to increase its tenacity. Said high-polymer fiber may be glass fiber, carbon fiber or dietary fiber.

Said foaming cement may be formed of the type of cement, whose density exceeds 400 kg/m$^3$ and whose thermal conductivity 0.8 w/mk, or by any other types of cements mixed with foaming gypsum, lightweight thermal insulation materials and gelatinizing materials.

The composition and content of said foaming cement are 10–70% dicalcium silicate, 10–70% anhydrous calcium sulphoaluminate, 10–70% sulphate dihydrate, 0–90% tricalcium silicate and 10–50% water, with thereto 1–10% foaming agent and 1–10% modifying additive mixtures.

Said surface layer of the foaming cement may be of elastic materials if without embedded reinforcing steel. Such surface layer can be made up of resin cement or elastic coating materials, etc.

Said surface layer of the foaming cement may be made into different patterns and shapes, such as brick face, stone carving, tiled shape, decorative line-arts or other ornamental designs.

Said surface layer of the foaming cement can be made into different colors or be coated with other colored finishing materials. For example, color cement can be coated on the surface layer, various surface paints can be brushed on it and decorative materials in wood grain pattern or those made from aluminum sheet, aluminum-plastic material, glass fiber reinforced plastics, stove tiles, other metals or plastic materials, can also become the panels therefor.

Said joint channels are lap joints (wedged or dovetailed) and the shape of which may be corrugated. Said joint channels can be socket or butt joint.

In the gap between connected joint channels, air-tight materials such as fluid sealants and foaming polyurethane may be filled in to make it waterproof.

Said reinforcement ribs are steel girders or small-sized shaped steels or small small-sized shaped steels with slots.

Said tension-resistant materials can be wire meshes, fibers, fiber lattice, dietary fibers or organic resins, etc.

Said steel reinforcements are formed of steel reinforcement bars surrounded by a given thickness of cement, and the steel reinforcement bars are connected to the said reinforcement ribs or to other anchored steel reinforcement members in the foaming cement.

Said reinforcement bars are placed between the tension-resistant surface materials and foaming cement entity under the surface layer, whereby not only bonding strength of foaming cement is increased but also the steel reinforcement bars are well protected by a given thickness of cement cover.

Said reinforcement ribs can be made up of frame materials other than steel girders or small-sized shaped steels.

Said shaped steel of the steel frame can be of tendons of smaller shaped girders or their combinations.

Said steel frame or girders may also refer to wood frames, girders or their combinations.

Said embedded expansion joints may be placed anywhere around or at the center of the cement board to fasten cement board either by bolting or riveting to the steel frame. Through fixation holes, set bolts fix the embedded expansion joints to the steel frame. Fixation holes can be changed on site accordingly. When used as exterior walls, proper joints channels assure the watertight connection in addition to the fluid sealant and site-foamed polyurethane applied thereto.

Said steel column may be formed of steels of various sections, like H-shape steel, square or round steel tube etc., or of steel core concrete column or ⌐, ⊤, +-shaped steel concrete column.

An A-type fender structure is formed by several A-type boards which are mechanically tied with one another by expansion joints or mechanically tied to the building steel skeleton. The expansion joints are at the ends of shaped steel frame and protrude out of the surface of the board.

Said A-type board is a board in which reinforcement ribs are embedded in foaming cement; cement surface layer strengthened with tension-resistant material is coated on the surface; steel reinforcements are placed in the binding area between foaming cement and cement surface layer; shaped steel frame mechanically tied with reinforcement rib is embedded in foaming cement; expansion joints of shaped steel frame protrude out of the surface of the board; and joint channels are made along the border of the board.

Said A-type board may be shaped into curved, angled or channeled designs.

Said A-type fender structure can be foamed on site. It begins from steel frame construction. After framework is well done, the cement surface layers can be prepared for decoration purpose. Besides this, other panels made of different materials, for example, metal, glass fiber reinforced plastics, wood or high-polymers, can be used instead for exterior and interior decoration. Then, these exterior and interior panels are mechanically fastened to the steel frame and the reinforcement ribs via joint members through thermal bridge. Next, cement foaming fluid is poured into the empty space, enclosed by exterior, interior boards, and steel frame, and begins to foam. Finally the whole wall is completed. Now, the exterior and interior boards may be partially connected with the reinforcement ribs, and the binding areas between surface layer and foaming cement entity can act as anchored concrete reinforcement in the foaming cement. When used for roofs, the exterior boards can be replaced with sheathings, tiled board or flexible waterproof material (See the Inventor's Application for Chinese Patent for Invention No. 99109346. I, which is incorporated herewith by reference in its entirety.).

With regard to A-type fender structure, it is possible to break it up into several parts according to drawings, in such a size as required by transportation, so that the steel frame, foaming cement, reinforcement ribs, tension-resistant materials, reinforcing steel and cement surface layer can be pre-cast in the factory. Windows may also be opened in the wall in factory, and all the individual parts can be assembled on site by bolting or welding. When connected by bolts, joint members can be embedded into the floor slab because it will be poured later on site; When welded, the columns may be split into two pieces of shaped steels and be welded together on site. (see the Inventor's Application for Chinese Patent for Invention No. 0010 0543. X, which is incorporated herewith by reference in its entirety).

A B-type fender structure is formed by B1 board and its mating part B2 with foaming cement, steel reinforcements and reinforcement ribs inside the boards; On the outer surface layer of B1 or B2 is the cement surface layer strengthened by tension-resistant materials; Inside the foaming cement of B1 board is embedded shaped steel frame mechanically tied to reinforcement ribs with the framework partially exposed. Upon the exposed part are many expansion joints. Inside B2 board are embedded expansion joints with fixation holes. There are joint channels haround both B1 and B2 boards; and the embedded expansion joints in B2 board are mechanically fixed to the steel frame inside B1 board.

A B-type fender structure, wherein it is formed of B1 board and its mating part B2 board. Inside the board are foaming cement, steel reinforcement and reinforcement ribs; on outer surface of B1 or B2 board is cement surface layer strengthened by tension-resistant material; inside foaming cement of B1 board is embedded shaped steel frame mechanically tied to reinforcement ribs with the steel frame partially exposed. Upon exposed part of the steel frame are expansion joints; Inside B2 board are embedded expansion joints with fixation holes; there are joint channels around the border of B1 or B2 boards; and the embedded steel expansion joints in B2 board are mechanically tied to steel frame inside B1 board.

Said B1-type board is the one in which reinforcement ribs are embedded in the foaming cement and a cement surface layer strengthened with tension-resistant material is coated only on one side of the board. In binding area between foaming cement and surface layer are the steel reinforcements. Inside the forming cement is embedded shaped steel frame mechanically tied to the reinforcement ribs with the steel frame partially exposed; outside the board are expansion joints and around the board are joint channels.

Said B2-type board is the one in which reinforced ribs are embedded in the foaming cement and a cement surface layer strengthened by tension-resistant materials is coated on one side of board. In binding area between foaming cement and surface layer are steel reinforcements; On the other side of the board are embedded expansion joints with fixation holes, and around the board are joint channels.

Said B1 and B2 boards may be shaped into curved, angled or channeled designs.

Said B2 board may be formed of other type of boards made with foaming cement, for example, gypsum, when used for exterior walls.

Said B-type fender structure, if used as roof, may be converted into tiled shape with steel frame exposed, and B2 board may not be used.

Said B-type fender structure may be broken up into several parts suitable for transportation. The work can be carried out in a line with the internal structure of the board without any sacrifice on its load-bearing capacity. Both B1 and B2 boards can be factory made. On construction site, the partially exposed steel frame inside B1 board is connected to one another with either bolts or rivets, and can be connected to B2 board via the embedded expansion joints inside B2. The built-in works, e.g. various pipes and wires, can be embedded between B1 and B2 boards. When used as exterior wallboard, it can be made waterproof with sealant filling the joint gap of lap, socket or butt joint channels. Steel expansion joints on exposed B1 steel frame are easy for use because they can be set wherever needed.

The B-type fender structure of this invention is a structure of large lightweight board and wallboard which are connected by welds and bolts. It is particularly suitable for dwelling houses as exterior walls, partition walls or roof boards and is getting popular for industrial use as exterior, fire-resistance and partition wallboards. (See the Inventor's Chinese Patent Application No. 00100542.1, which is incorporated herewith by reference in its entirety)

A C-type fender structure is formed by two cooperating C1 and C2 boards with foaming cement, reinforcing steel and reinforcement ribs inside. On the outer surface of C1 or C2 is the cement surface layer strengthened by tension-resistant materials; Between C1 and C 2 boards is the shaped steel frame; Inside the board are embedded expansion joints with fixation holes and around the board are the joint channels.

Said C-type board is the board in which reinforcement ribs are embedded in foaming cement, a cement surface layer strengthened with tension-resistant materials is coated outside on one side of the board, while on the other side are the embedded expansion joints; steel reinforcements are placed between surface layer and foaming cement. Around the board are the joint channels.

When said C-type fender structure is used as roof boards, the cement surface layer of said C1 board can be made into tiled shape, the steel frame may still be exposed but the C2 board may not be used.

When said C-type fender structure is used as roof boards, said C1 board may be formed of rolled metal sheets, cement tiles, etc. to make it waterproof, while C2 board can be the heat insulation and fire resistant ceiling.

Said C1 and C 2 boards may be made into curved, angled or channeled designs.

When C-type fender structure is used as exterior walls, C1 board may be equipped with an air barrier on its inner side to make the exterior wall damp-proof in cold regions.

Said C2 board may be formed with materials other than foaming cement, for example, the gypsum when used as exterior wall.

Said members of steel frame in C-type fender structure should be made in factory and installed on site. The various building loads will be carried by steel frame. On construction site, the steel frame is first assembled and then are the C1 and/or C 2 boards. Depending on the load, different bolts and rivets may be chosen. The two boards are clinched to the steel frame via embedded steel expansion joints with fixation holes of C1 and C2 board. After fixation, fixation holes can be filled with special material, which is a mixture of cement and lightweight heat insulation material. This mixture can be that of cement and pearlite or that of cement and polystyrene. Moreover, various pipes and wires can be laid in between C1 and C2 boards.

This invention also provides a special column structure which, formed of profiled steel concrete or shaped steel girders, is as thick as the walls of building. It can be in ⌐, ⊤, and +-shape and can substitute for the steel column.

On occasion in which the diameter of shaped steel column is wider than the thickness of wall, special fireproof boards—C3-type—may be applied for the purposes of decoration. Other decorative materials may also do. (See the Inventor's Application for Chinese Patent No. 0010 0541.3, which is incorporated herewith by reference in its entirety)

Said various load-bearing fender structures may be used together and form a variety of building structures in cooperation with shaped steel columns, floor slabs, decorative members, ceilings and partition wallboards.

The shaped steel columns may be of the composite ⌐, ⊤and +-shaped columns.

The shaped steel columns may cooperate with A, B or C girder fender structure to support floor slabs at top and bottom ends thereof If placed in a staggered fashion between floors, they may form a bay of double span. The floor slabs made from girders and ceilings can form a fire-resistance, lightweight, large-span bay over load-carrying walls. The girders thereof may be made of steel or wood. Said floor slabs, as lightweight fireproof building members, may be molded on site with reinforcement members, or be cast with steel or wood moulds, or be poured with pre-stressed lap boards, or be formed by foaming cement ceiling with girders.

Said ceiling may be made of C-type board.

This invention provides an assembled partition wallboard with reinforcement ribs embedded in the foaming cement, cement surface layer strengthened with tension-resistant materials, steel reinforcement placed at the place of binding area between surface layer and the foaming cement. There are joint channels along both sides of the board with bolt fixation on top and bottom side of the board. The set bolts are connected to the reinforcement ribs. On corresponding places of roof boards and floor slabs there are holes or joint channels for the bolt fixation.

For large-spanned buildings, assembled partition wallboards may be used so that the room space may be arranged in different ways to meet actual needs. (See the Inventor's Application for Chinese Patent No. 0010 0544.8, which is incorporated herewith by reference in its entirety)

This invention also provides a process for forming fire resistance structures of many shapes, whereby the easiness of forming and processing of foaming cement in moulds is made use of. It can be used for exterior and interior decoration or for landscape, and comprises the following steps:

Step One: Reinforcement ribs and small embedded expansion joints are first cast on site with foaming cement;

Step Two: Surface of the foaming cement is processed into desired shapes for decoration, and the reinforcement ribs embedded in the cement are partially exposed out of the foaming cement surface in a way that is used as steel reinforcements later.

Step Three: Spraying or brushing tension-resistant materials on the surface of foaming cement to form surface layer.

This method, whereby the foaming cement is made at first and then its surface is shaped into different designs when cement is set. Steel reinforcement bars embedded in foaming cement are partially exposed, so that they can form steel reinforcements with surface layer cement when it is sprayed or brushed on the foaming cement entity. With this method it's easy not only to accomplish many decorative designs but also to enhance the bonding strength between surface layer and foaming cement through the steel reinforcements.

This method can produce A, B or C-type boards, panels or joint channels in many decorative shapes, and, when applied to roofing, can produce corrugated or tiled decorative designs for roof drain system.

Said decorative structure is formed of airtight-cavity foaming cement with decorative surface layer. The shape of decorative design is set by steel frame inside while reinforcement ribs are mechanically tied to the steel frame and connected with steel reinforcement, which is placed in binding area between foaming cement and the decorative surface layer. In the said foaming cement may be embedded expansion joints with fixation holes.

Said architectural decorative pattern may be used for fascia, column head, lintel, column contour, handrail as well as a variety of inner and outside objects, such as rockery, garden sculpture, scenery landscape etc. (See the Inventor's Chinese Invention Patent No. 00100545.6, which is incorporated herewith by reference in its entirety)

This invention provides a process for old building renovation with steel structures, whereby the foundation of existing heavyweight structure can be reused. This Inventor's A, B or C-type truss fender structures can be used as partition walls and A, B or C-type fender structures as exterior walls. The assembled partition boards are used for interior partition walls. In cooperating with steel columns, floor slabs, decorative structures and ceiling, the steel columns and steel structure of the old building are firmly held together. A lightweight structure is constructed on the top of the building. Where the technical condition permits, the foundation is reformed to accommodate the newly lightweight building structures. Then, with many cooperating floor slabs cast on site, the steel columns are somehow safely connected to the existing building with a temporarily set supports and cables to stabilize the entire building. Possible storeys of the new building depend on the condition of the foundation, and the construction work can be carried on from the top of old building. With the new building going up, the old building is demolished and renovated from top down. The demolition and renovation should be carried out within the load-bearing capacity of the foundation and continued until the entire old building is pulled down, and then anther reconstruction work could be done for the foundation. With this technology, the renovation project is easily executed by pulling down old buildings to construct new ones on the foundation of the former.

For this invention another patented invention of the inventor is used, namely "the technology of installing guyed structure on steel columns of the structure skeleton of a main steel structure in the process for constructing dwelling houses" (the Inventor's Patent Application No.99109102. 7, which is incorporated herewith by reference in its entirety), so as to ensure the stability in the process of construction. This is a technology whereby a steel boot structure is set under steel columns of main building steel structure. Because it distributes pressure in a larger area of the ground, building construction can be stabilized under vertical load. Using this technology would make it possible to construct a platform on top of any existing one-storied or multiple-storied buildings, so that normal human life is kept intact therein, while upper parts is being constructed on the platform. After the upper parts of the house are made available for use, residents from lower floors may move up and the lower parts are demolished, and the foundation reconstruction work begins.

Said guyed structure may be realized by effectively connecting two steel structures of adjacent individual buildings of steel structure. Since the steel connecting members of each building are pre-designed and connected to main building structure, this building's joint members can couple with those of others to make adjacent buildings into one unit. Turning the individual buildings into a part of the whole structure of a building group not only makes the latter well established but also ensures the stability of the former. In this invention, newly renovated buildings may be laterally connected to a building group to attain stability and diversified utilization, for example, suspended gardens, shopping malls and sports centers, etc.

With a process of this invention to build steel structures for renovation of old buildings, steel connecting structures may be used to connect adjacent steel structures in order to turn a separate building into a part of whole buildings, which stabilizes not only the grouped buildings but also individual ones, so that the newly built higher buildings standing on the foundation of existing old ones are laterally stable. The connected steel structure may be formed of A, B or C-type fender structure, so that it becomes suspended. Ropes or cables may be used for temporary fixation during the construction. The connecting structure may vary in shape as corridors, arched bridges or a H-shaped structures. Said connecting structure may connect several individual buildings to form building clusters.

To ensure the lateral stability of the higher building newly erected on the foundation of the existing building, the connecting steel structure may be used to connect adjacent buildings to turn an individual building into a building cluster in order to stabilize both the cluster and the individual buildings. The connecting steel structure may be formed of A, B or C-type fender structure to make it a suspended building. Ropes or cables may be used for temporary fixation during construction. (See the Inventor's Application for Chinese Invention Patent No. 00100693.2, which is incorporated herewith be reference in its entirety.)

BRIEF DESCRIPTION OF THE ACCOMPANYING DRAWINGS

FIG. 2-1 is the schematic diagram of A-type fender structure of this invention.

FIG. 2-2-1 is the schematic diagram of A-type board with lap joint of this invention.

FIG. 2-2-2 is the schematic diagram of A-type board with socket joint of this invention.

FIG. 2-2-3 is the schematic diagram of A-type board with butt joint of this invention.

FIG. 2-3 is the schematic diagram of blanket columned A-type fender structure of this invention.

FIG. 2-4 is the schematic diagram of A-type truss fender structure of this invention.

FIG. 3-1 is the schematic diagram of B-type fender structure of this invention.

FIG. 3-2-1 is the schematic diagram of B1-type board with lap joint of this invention.

FIG. 3-2-2 is the schematic diagram of B1-type board with socket joint of this invention.

FIG. 3-2-3 is the schematic diagram of B1-type deck with butt joint of this invention.

FIG. 3-3-1 is the schematic diagram of B2-type board with lap joint of this invention.

FIG. 3-3-2 is the schematic diagram of B2-type board with socket joint of this invention.

FIG. 3-3-3 is the schematic diagram of B2-type board with butt joint of this invention.

FIG. 3-4 is the schematic diagram of Application 1 with blanket columned B-type fender structure of this invention.

FIG. 3-5 is the schematic diagram of Application 2 of B-type truss fender structure of this invention.

FIG. 4-1 is the schematic diagram of C-type fender structure of this invention.

FIG. 4-2-1 is the schematic diagram of C-type board with lap joint of this invention.

FIG. 4-2-2 is the schematic diagram of C-type board with socket joint of this invention.

FIG. 4-2-3 is the schematic diagram of C-type board with butt joint of this invention.

FIG. 4-3 is the schematic diagram of Application 1 of blanket columned C-type fender structure of this invention.

FIG. 4-4 is the schematic diagram of Application 2 of C-type composite column fender structure of this invention.

FIG. 4-5 is the schematic diagram of Application 3 of C-type truss fender structure of this invention.

FIG. 4-6 is the schematic diagram of Application 4 of the profiled C-type fender structure of this invention.

FIG. 5 is the schematic diagram of assembled partition wall of this invention.

FIG. 6-1 is the schematic diagram of Application 1 of decorative pattern of this invention.

FIG. 6-2 is the schematic diagram of Application. 2 of the decorative pattern of this invention.

DESCRIPTION OF EMBODIMENTS

This invention is further explained by way of examples with reference to the accompanying drawings of the description.

Figure 1:
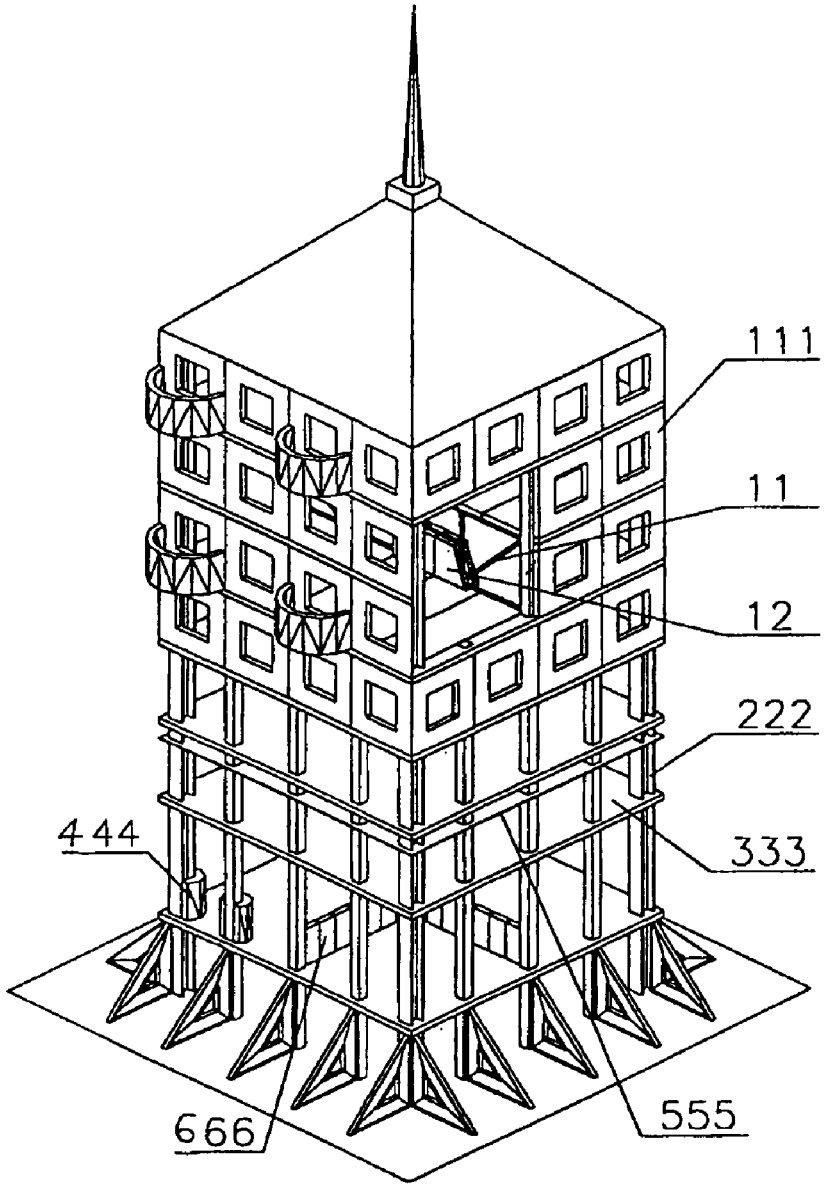
FIG. 1 is the schematic diagram of the structure of this invention.

The Structural System of this Invention as Shown in FIG. 1:

This invention mainly comprises load-bearing fender structure (111), shaped steel columniation (222), floor slabs (333), decorative design (444), ceiling(555) and assembled partition wall(666), wherein the load-bearing fender structure (111) is formed of A-type fender structure, B-type fender structure or C-type fender structure. Of them said A-type fender structure, in turn, is formed of several A-type boards; said B-type fender structure is formed of two mating B1 and B2 boards; and said C-type fender structure is formed of two mating C1 and C2 boards.

Figures 1, 2:
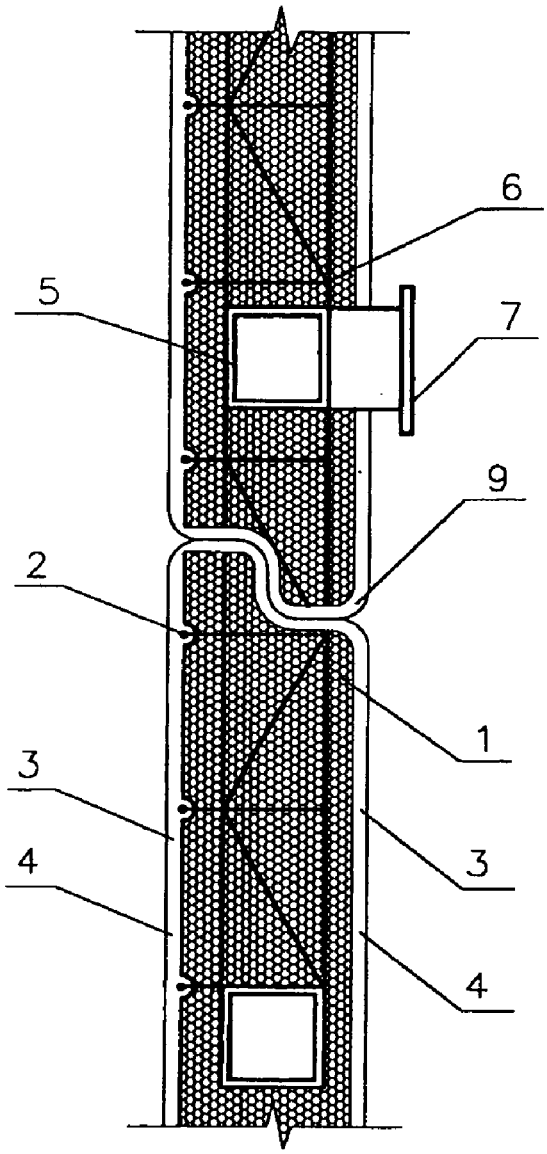
Figures 1, 2:
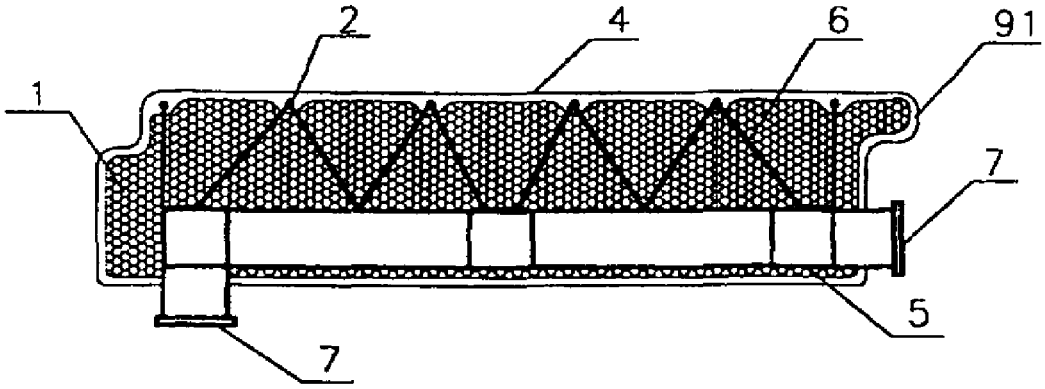
Figure 2:
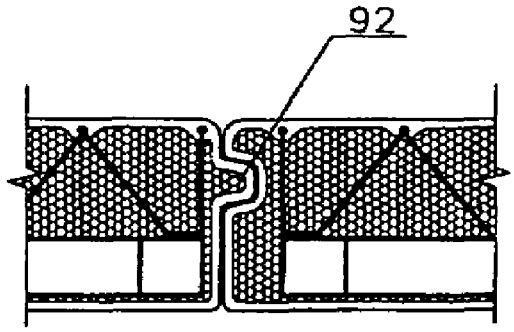

As is shown in FIG. 2-1: A-type fender structure of this invention is the structure in which reinforcement ribs (6) are embedded in the foaming cement (1); the cement surface layer (4) strengthened by tension-resistant material (3) is coated outside; steel reinforcement (2) is set between foaming cement entity(1)and cement surface layer (4); shaped steel frame (5) is tied with reinforcement rib (6) in the foaming cement (1); expansion joint (7) of the steel frame (5) protrudes outside the surface of the board; and joint channel (9) edges the border.

Moreover, fluid sealant may be applied to joint gap between two joint channels (9) to make it waterproof.

As FIG. 2-2-1 shows: A-type board with lap joint of this invention is the one in which reinforcement ribs (6) are embedded in the foaming cement (1); cement surface layer (4) strengthened by tension-resistant material (3) is coated outside; steel reinforcement (2) is set between foaming cement entity(1)and cement surface layer (4); shaped steel frame (5) mechanically tied with reinforcement ribs (6) is embedded in the foaming cement (1); expansion joint (7) of the steel frame (5) protrudes outside the surface of the board and the lap joint channels (9) edges the border. When the board is used as roofing, cement surface may be corrugated and the lap joint channels (91) be corrugated.

As FIG. 2-2-2 shows, socket joint A-type board is different from lap A-type board in that socket joint channel (92) is along the border instead.

Figures 2, 3:
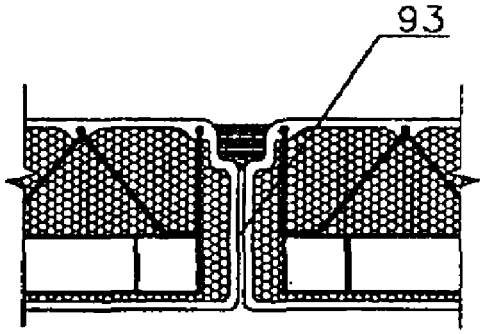
Figures 2, 3:
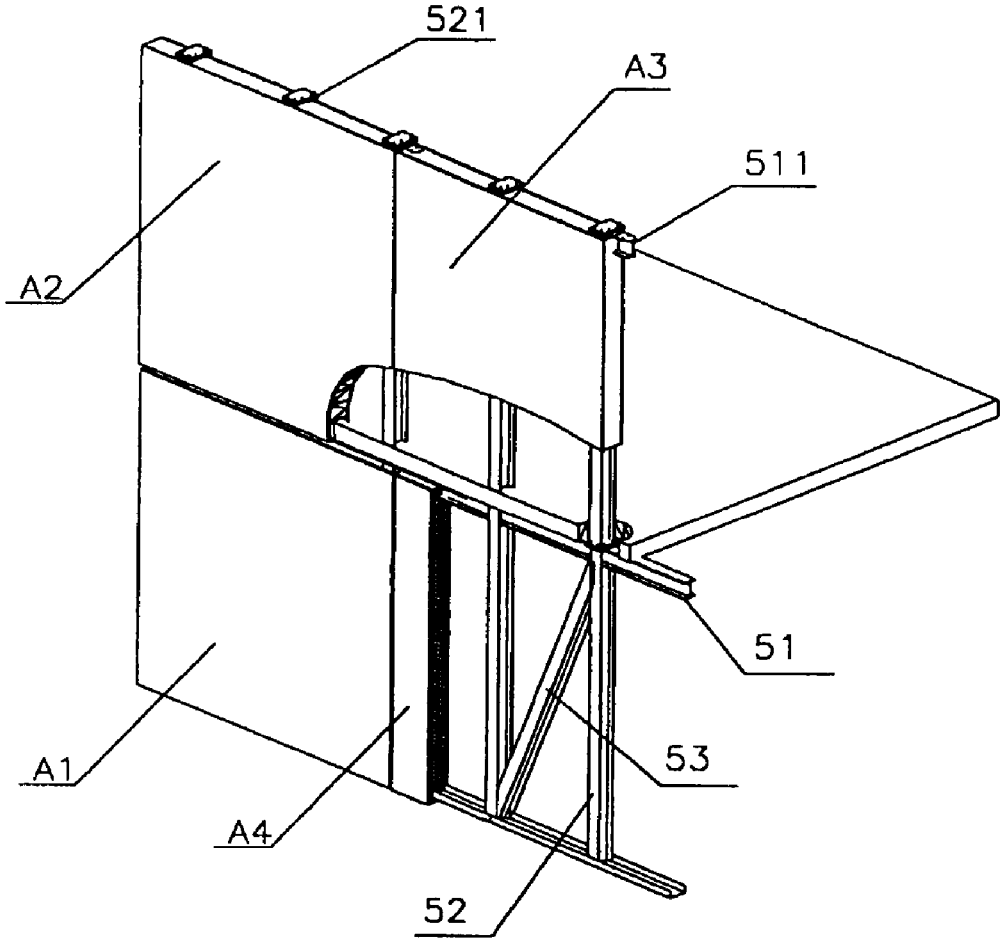

As FIG. 2-2-3 shows, butt joint A-type board is different from lap A-type board in that butt joint channel (93) is along the border instead.

There are two best examples of A-type fender structure of this invention:

EXAMPLE 1

As FIG. 2-3 shows, blanket columned A-type fender structure is formed by A1, A2, A3 or A4 boards, and inside them is the steel frame composed of beams (51), columns (52), braces (53), beam expansion joints (511) and column expansion joints (521). The columns (52) may be replaced by vertical girders(?) to become composite columns, which may be placed at the comer of a building, at the place where exterior and interior wall meets or the intersection of partition walls, and at the place as required for load carrying.

EXAMPLE 2

Figures 2, 3, 4:
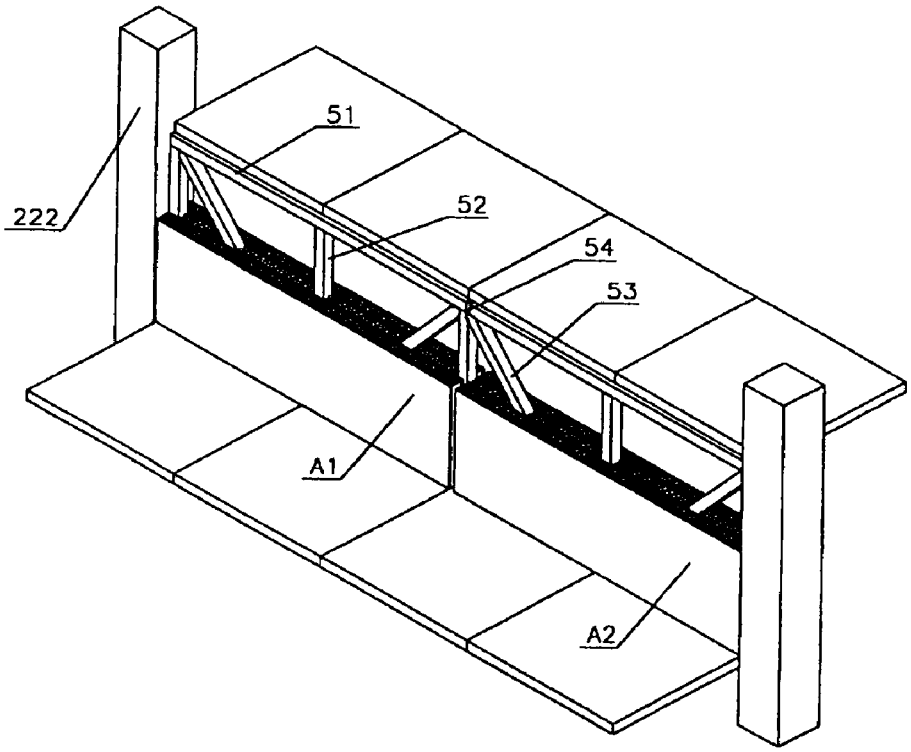

As FIG. 2-4 shows, integrated A-type truss fender structure is formed of A1 and A2 boards, in which are placed the steel frame formed of beams (51), columns (52), braces (53). The girders inside A1 and A2 boards are connected into a whole structure using the expansion joints (54) of the steel frame with which the boards are connected, and are formed into a integrated structure with the columniation (222) placed on each end thereof. The columniation in the structure may be the various steel columns, steel core concrete columns, special ⌐, ⊤or +-shaped steel core concrete columns and grouped columns of ⌐, ⊤or +-shaped girders. The columns may be placed at the comer of a building, in the place where the outer and inner walls meet, in the place where the inner partition walls crisscross, or any place as required for carrying the load of the building.

As FIG. 3-1 shows, the B-type fender structure of this invention is formed of B1 and B2 two mating boards. Inside the boards there are foaming cement (1), steel reinforcement (2) and reinforcement ribs (6), and on the outer surface of the boards is the cement layer (4) strengthened by tension-resistant material (3), wherein shaped steel frame (5) mechanically tied with steel reinforcement (6) is embedded in the foaming cement (1) of B1 board, with a part of steel frame (5) exposed and on top of which there are the expansion joints (71) of the frame (5); embedded in B2 board are the expansion joints (72) and the fixation holes (8); along the outer edge of the B1 and B2 boards are the joint channels (9); and on the inner surface of B1 board is an isolated layer to facilitate damp-resistance of the outer wall in cold regions. In addition, the fluid sealant may be applied to the gap between connecting joint channels (9)to make it waterproof.

As FIG. 3-2-1 shows, lap joint B1-type board of this invention is one in which reinforcement ribs (6) are embedded in the foaming cement (1); there is a cement surface layer (4) strengthened by tension-resistant material on one side of the board's outer surface; steel reinforcement (2) are embedded in binding area between the foaming cement (1) and cement surface layer (4); steel frame (5) mechanically tied with reinforcement ribs (6) is embedded in the foaming cement (1), with a part thereof exposed; on it there are expansion joints (71) for the frame(5); and there are lap joint channels (91) along the border of the board.

As FIG. 3-2-2 shows, socket joint B1-type board is different from lap ones in that there are socket joint channels (92) along the border.

As FIG. 3-2-3 shows, butt joint B1-type board is different from lap B1-type board in that there are butt joint channels (93) along the edge.

As FIG. 3-3-1 shows, B2-type board of this invention is the one where reinforcement ribs (6) are embedded in the foaming cement (1), wherein there is the cement surface layer (4) strengthened by tension-resistant material(3) on one side of its outer surface; there are steel reinforcement (3) at the bonding place between foaming cement (1) and cement surface layer (4); there are embedded the expansion joints (72) and fixation holes (8) on the other side; and there are joint channel (91) around the border.

As FIG. 3-3-2 shows, socket joint B2-type board is different from lap B2-type board in that there are socket joint channels (92) around the border instead.

As FIG. 3-3-3 shows, butt joint B2-type board is different from lap B2-type board in that there are butt joint channels (93) around the border instead.

There are two Best Examples of the B-Type Fender Structure of this Invention:

EXAMPLE 1

As FIG. 3-4 shows, blanket columned B-type fender structure is formed of B1 and B2 boards with shaped steel frame composed of beams (51), girders (511), columns (52), braces(53) and expansion joints (71). The column (52) in said steel frame may be replaced by girders formed of vertical columns to form composite truss columns of ⌐, ⊤or +-shapes, which may be placed at the corner of a building, at the intersection where exterior and interior walls meet or where the inner partition walls crisscross, or in any places as required for carrying the load.

EXAMPLE 2

Figures 1, 3:
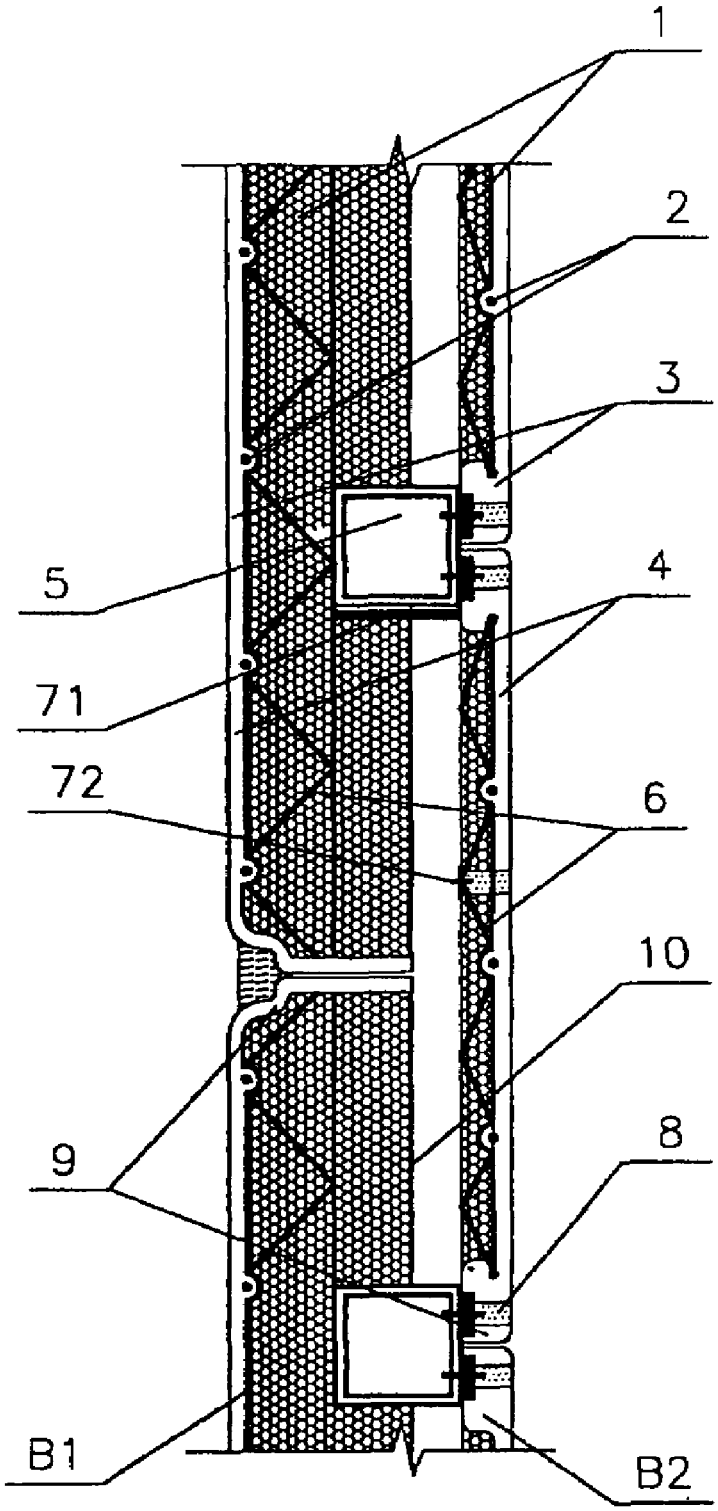
Figures 1, 2, 3:
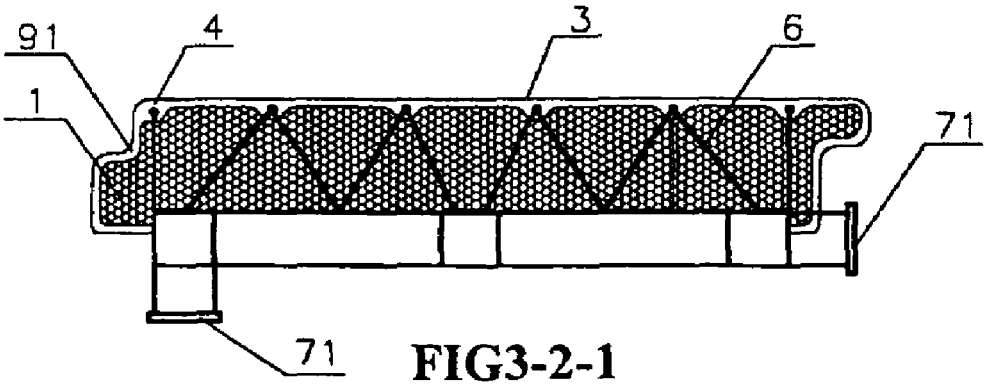
Figures 2, 3:
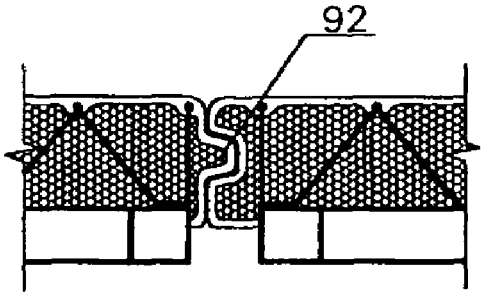
Figures 2, 3:
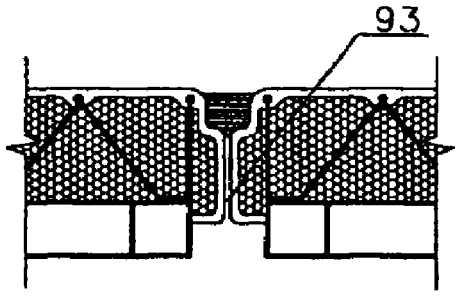
Figures 1, 3:
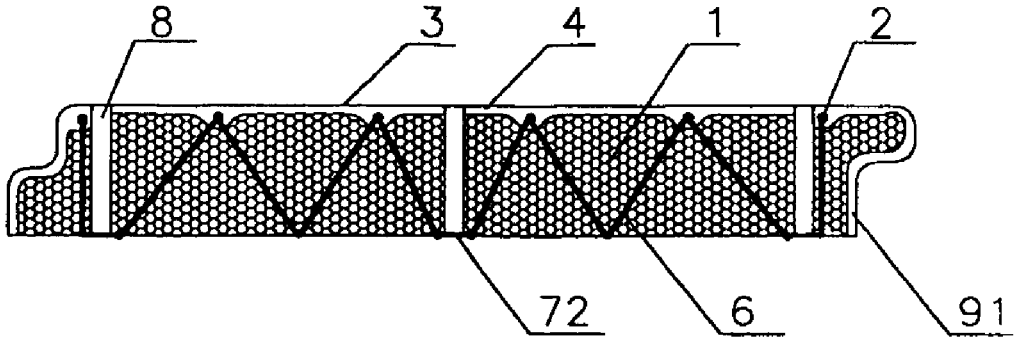
Figures 2, 3:
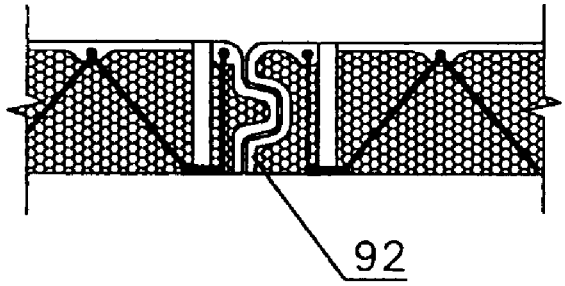
Figure 3:
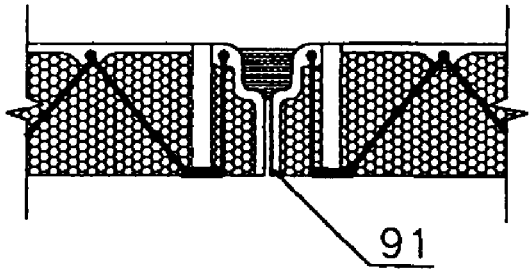
Figures 3, 4:
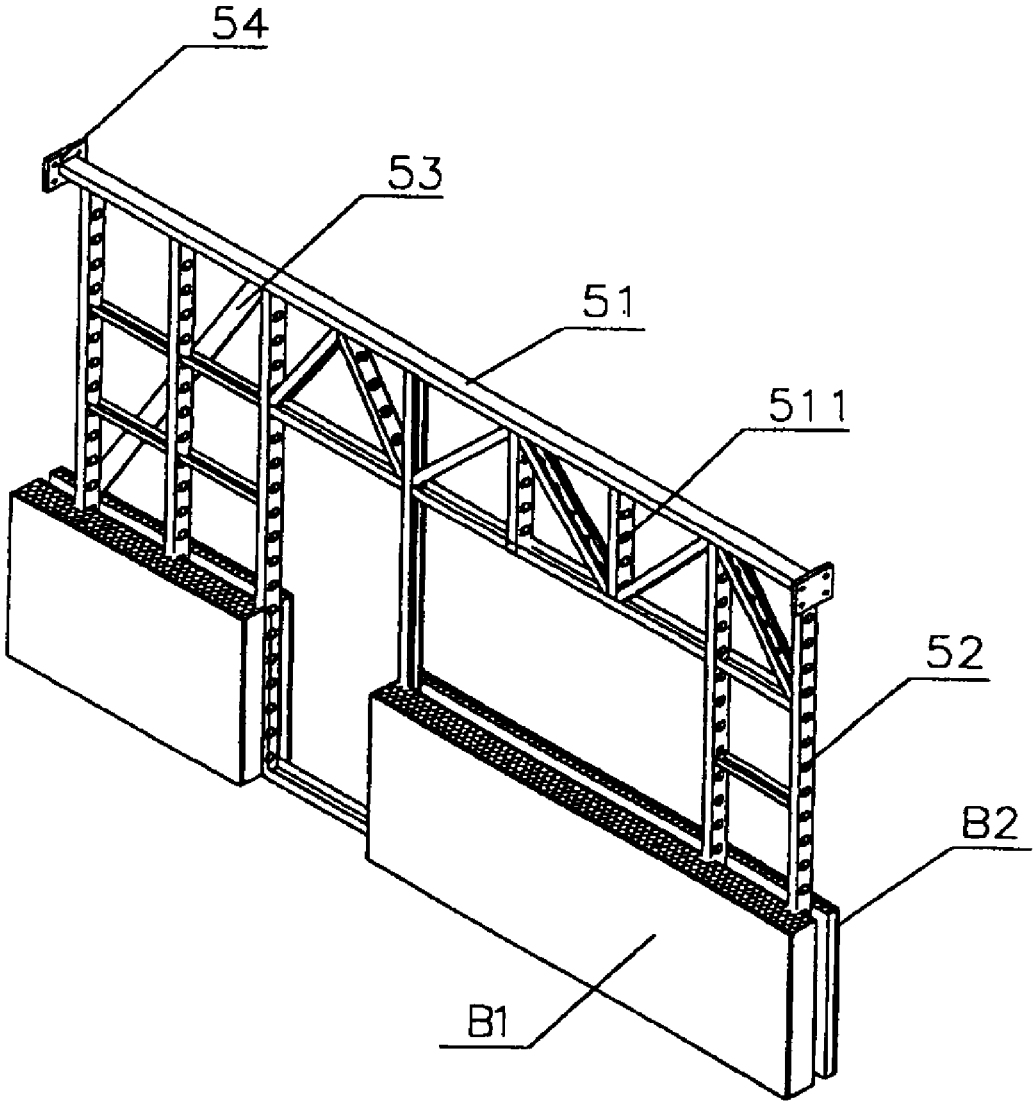
Figures 3, 4, 5:
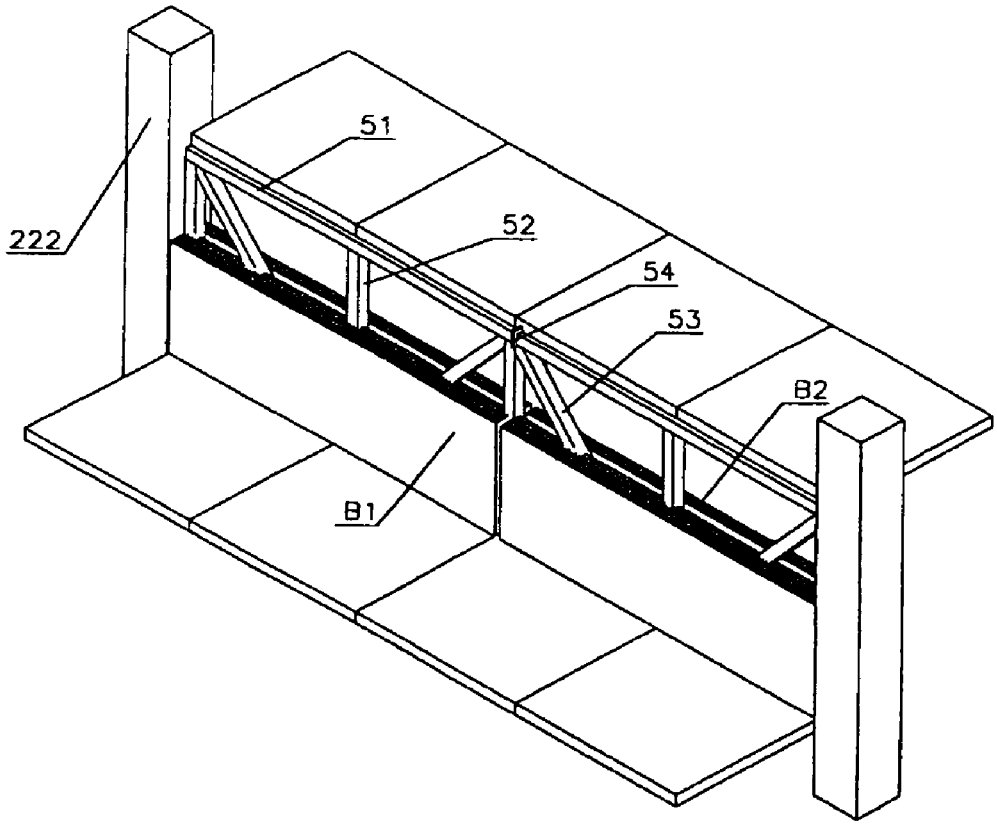

As FIG. 3-5 shows, the integrated B-type truss wall structure is formed of the B1 and B2 board with shaped steel frame composed of beams(51), columns (52), braces (53) and expansion joints(71). When used in buildings, this wall structure should be equipped with steel columniation (222) at the two ends of integrated truss. The columniation may be of various shaped steel columns, steel-core concrete columns, special ⌐, ⊤or +-shape steel-core concrete columns and the composite columns of ⌐, ⊤or +-shaped girders. It may be placed at the comer of a building, in places where outer and inner walls meet, or where inner partition walls crisscross, or any other places as required for carrying the load of building.

As FIG. 4-1 shows, C-type fender structure of this invention is formed of C1 and C2 two mating boards. In these boards are foaming cement (1), steel reinforcement(2) and reinforcement ribs (6); on their outer surface is the cement surface layer (4) strengthened with tension-resistant material (3); in between the C1 and C2 boards are steel frame (5); inside C1 or C2 boards are embedded expansion joints(7) and fixation holes (8); along the outer edge of C1 or C2 board are the joint channels(9). On inner surface of said C1 board there may be installed with an isolate layer to facilitate damp-resistance of the houses when used as exterior walls in cold regions.

Furthermore, fluid sealant may be applied to the gap where joint channels (9) are connected so as to make it water proof.

As FIG. 4-2-1 shows, lap joint C-type board of this invention is the one where reinforcement ribs (6) are embedded in foaming cement (1). There is a cement surface layer (4) strengthened with tension-resistant material (3) coated on one side of its outer surface and the embedded expansion joints are on the other side. There are fixation holes (8) on embedded expansion joints, steel reinforcement(2) in the binding area formed by foaming cement (1) and cement surface layer (4), and lap joint channels (91) around the border.

As FIG. 4-2-2 shows, socket joint C-type board is different from lap C-type board in that there are socket joint channels (92) around the border instead.

As FIG. 4-2-3 shows, butt joint C-type board is different from lap C-type board in that there are butt joint channels (93) around the border instead.

There are Four Best Applications by C-Type Fender Structure of this Invention:

EXAMPLE 1

As FIG. 4-3 shows, blanket columned C-type fender structure is formed of steel frame composed of beams (51), girders (511), columns (52), braces (53) and laterally arranged C1 and C2 boards.

EXAMPLE 2

As FIG. 4-4 shows, blanket columned+composite column C-type fender structure is formed of ⊤or +-shaped composite column (54), which is the girders combined in vertical, and steel frame which is formed of beams(51), columns (52) and laterally arranged C1 and C2 boards. The composite columns (54) may be placed at the corner of a building, the cross where outer and inner walls meet, the crisscross of inner partition walls, or any place for carrying the load, in the shape of ⌐, ⊤or +-patterns. The foaming cement ceiling board (555) together with girders (334) can buildup a perfect fire resistant, lightweight floor slab(333).

EXAMPLE 3

As FIG. 4-5 shows, C-type integrated truss wall structure is formed of beams(51), columns (52), braces (53) and C1, C2 boards. This fender structure, when used in buildings, should have steel columniation (222) set at the two ends of integrated truss. The columniation may be of various shaped steel columns, steel core concrete columns, special ⌐, ⊤or +-shaped steel core concrete columns and composite columns with ⌐, ⊤or +-shaped girders. This fender structure may be placed at the corner of a building, in the place where the outer and inner walls meet, in the place where the inner partition walls crisscross, and in any place as is required for carrying load of the building.

Application 4: As FIG. 4-6 shows, special C3-type board may be used as fire-proof decorative material for steel column (2) when the section size of steel column is larger than the thickness of wall.

As FIG. 5 shows, assembled partition board structure of this invention is the one where reinforcement ribs (6) are embedded in foaming cement(1); cement surface layer (4) strengthened with tension-resistant material (3) is coated on the surface of foaming cement(1); steel reinforcement(2) are embedded in the binding area between cement surface layer (4) and foaming cement (1); joint channels (9) are on the right and left sides of the board; and fixation bolts (5) on top and bottom of the board with these bolts(5) fastened to the reinforcement ribs (6).

Figures 1, 4:
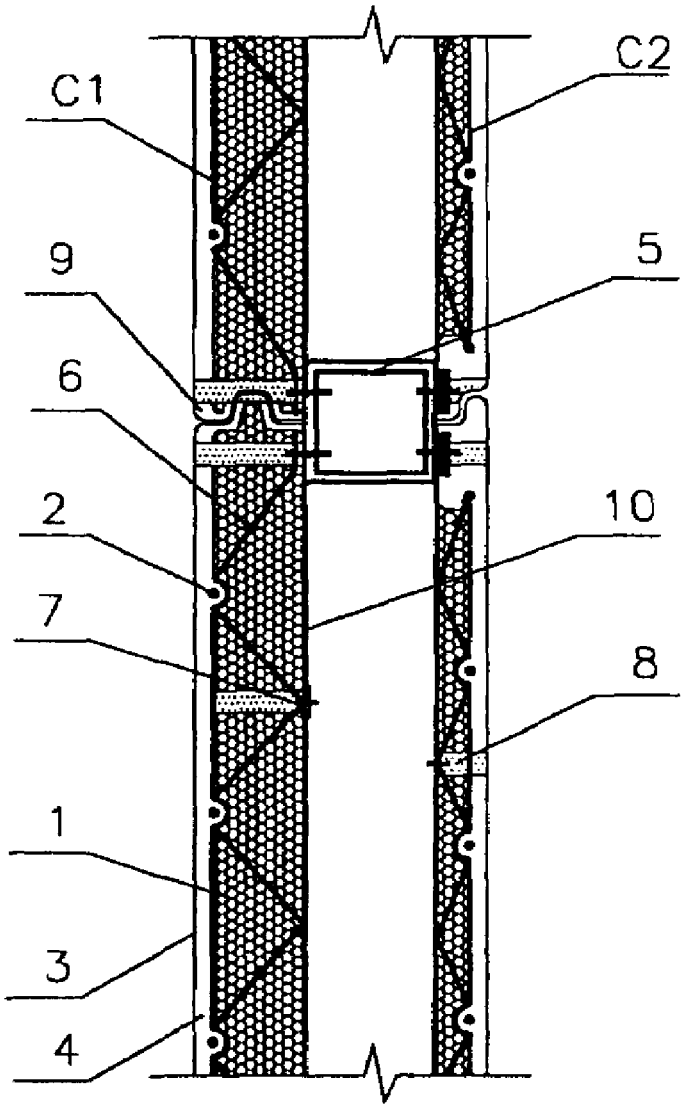
Figures 1, 2, 4:
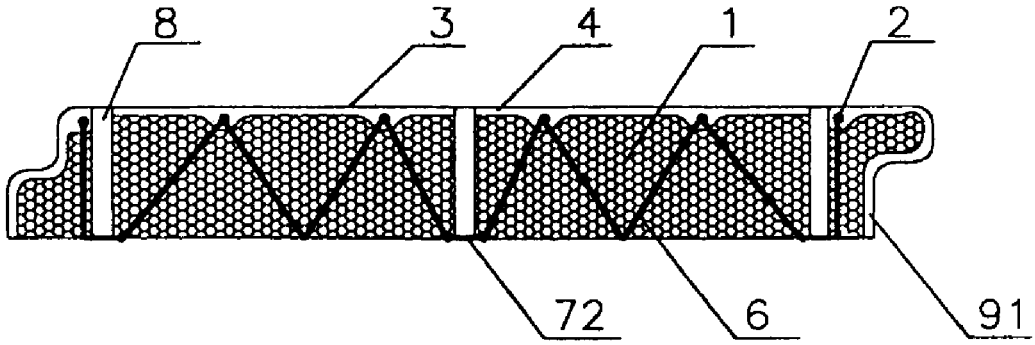
Figures 2, 4:
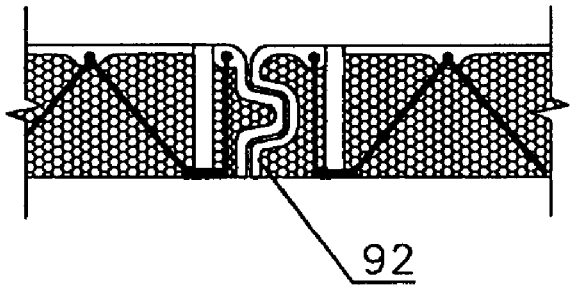
Figures 2, 3, 4:
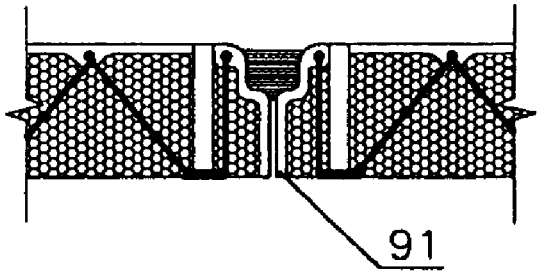
Figures 3, 4:
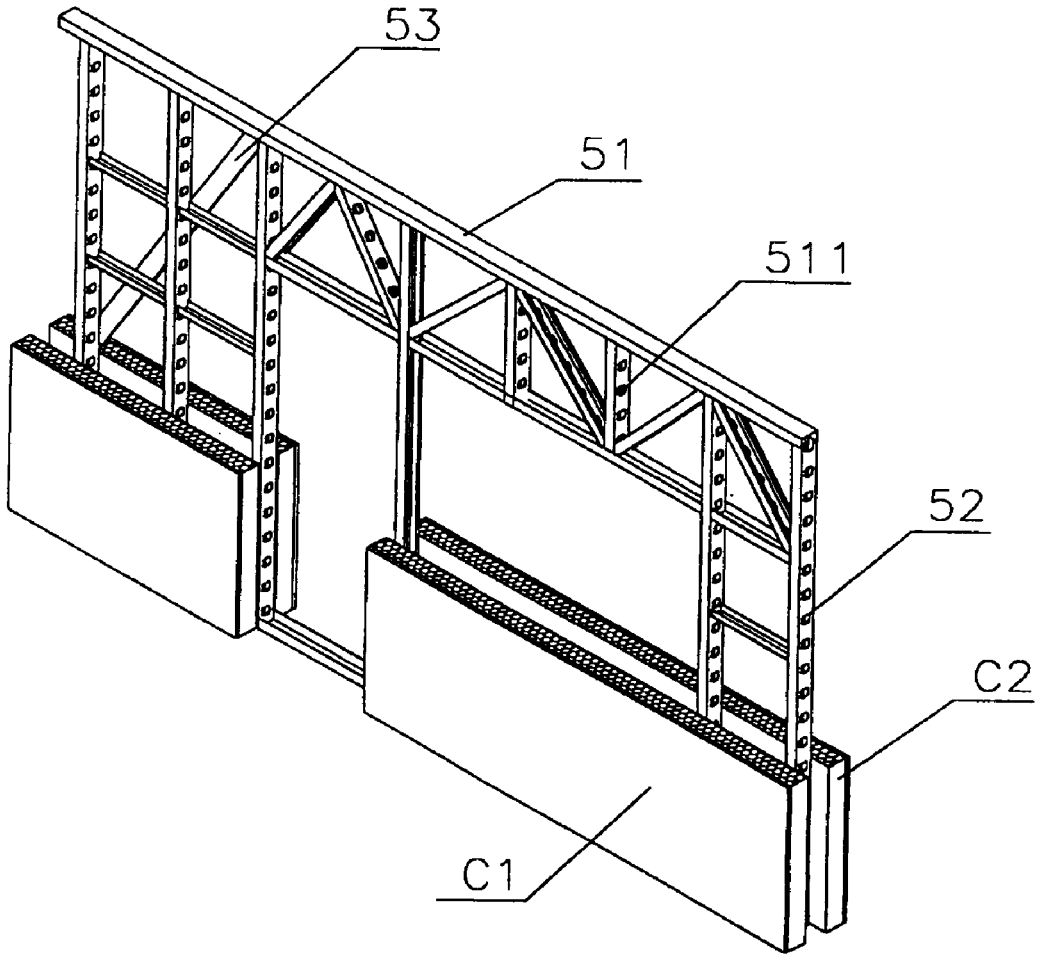
Figure 4:
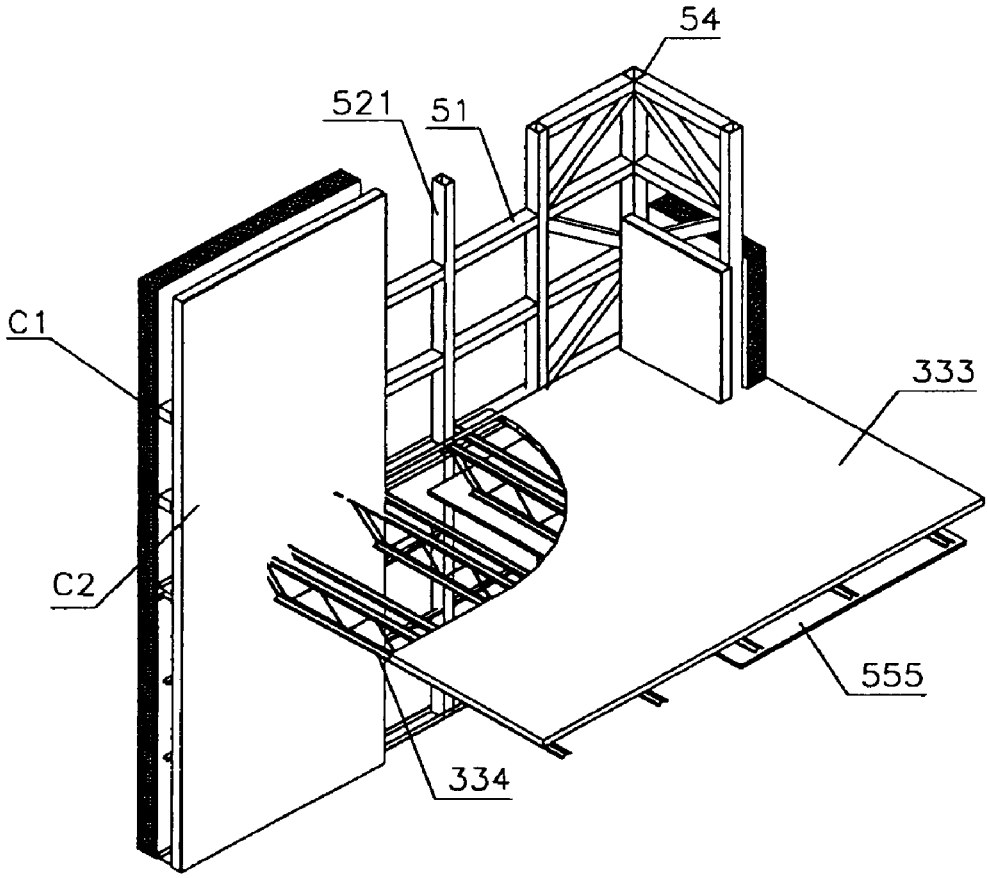
Figures 4, 5:
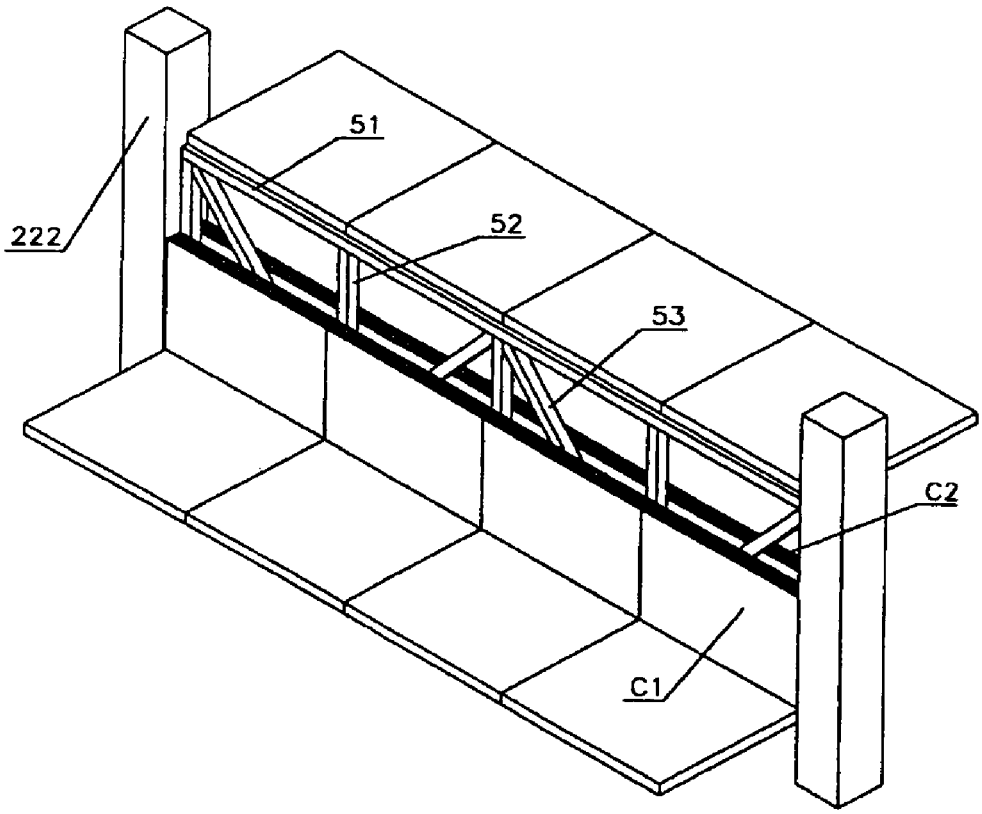
Figures 4, 5, 6:
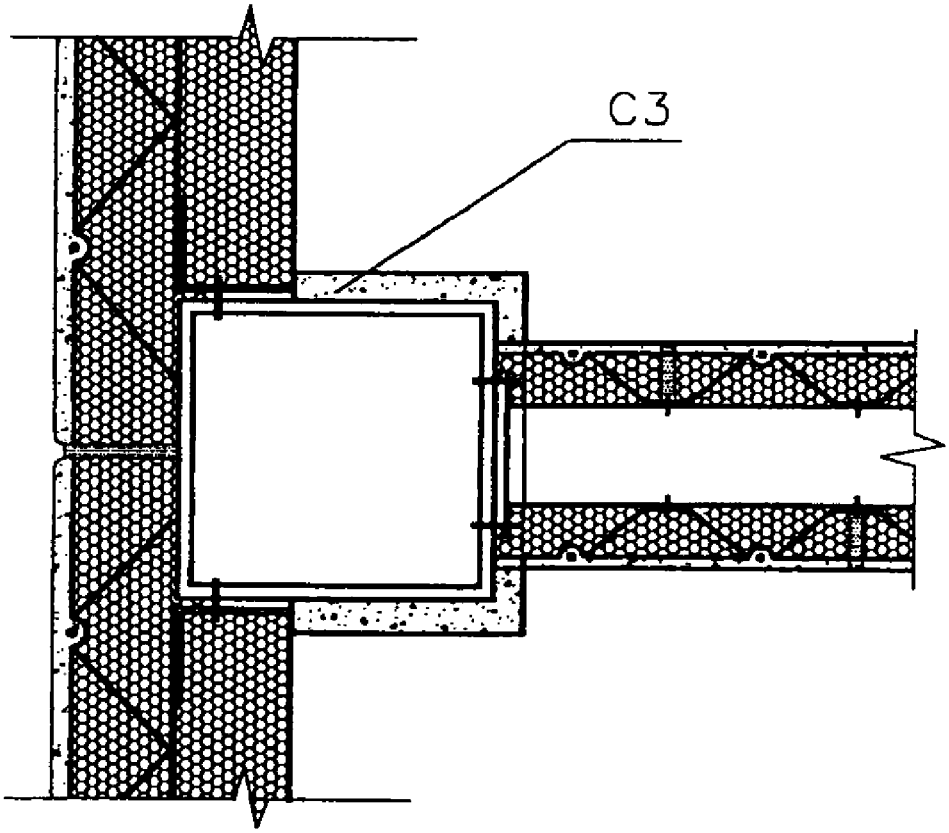
Figure 5:
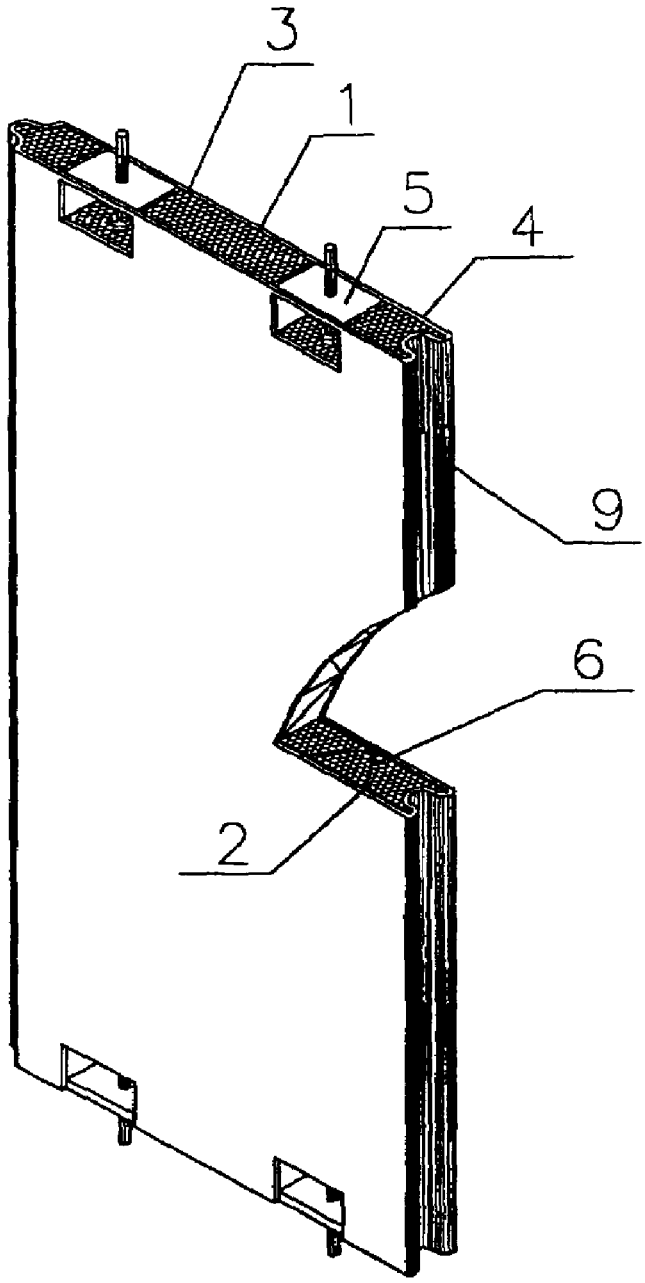
Figures 1, 6:
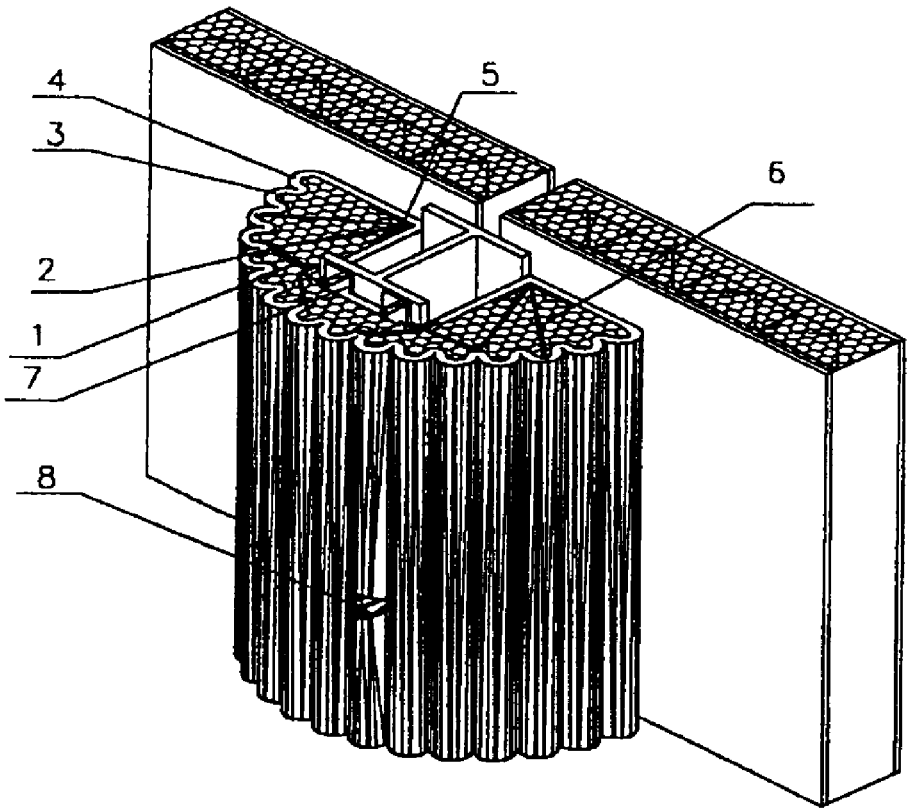
Figures 2, 6:
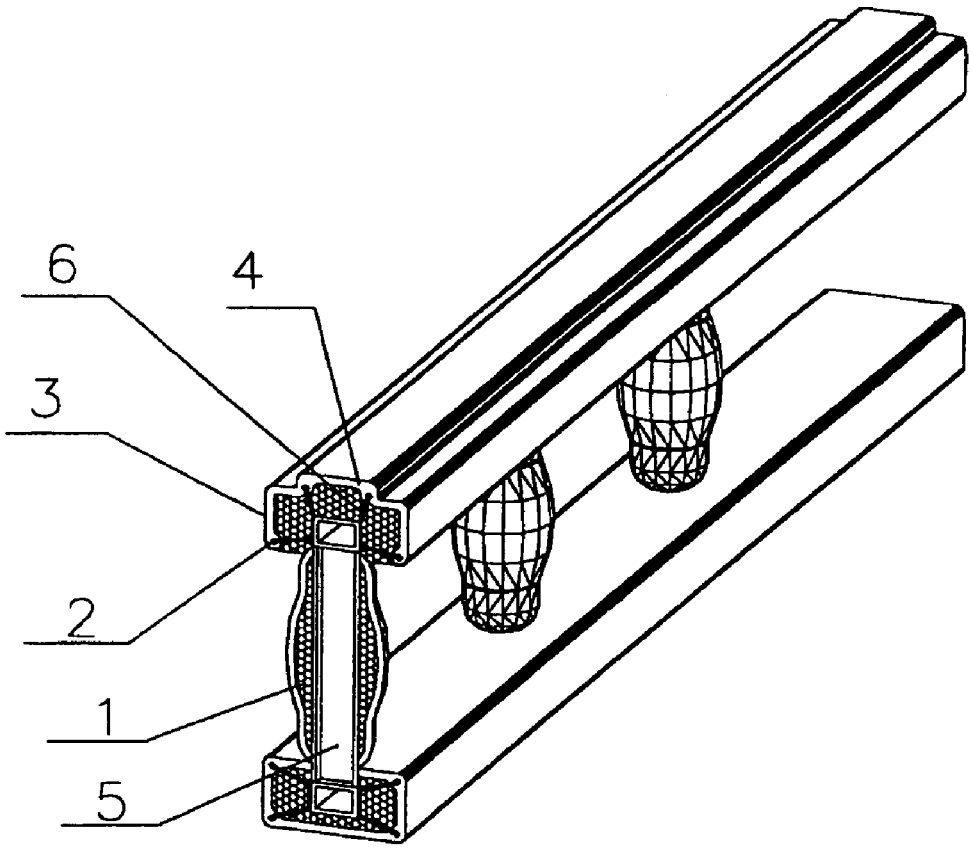

As FIG. 6-1 shows, Example 1 is a decoration example of this invention.

A decorative column which can be roughly shaped into a desired pattern with steel frame (5) is mainly formed by this airtight-cavity foaming cement (1) and a decorative surface layer(4); the reinforcement ribs (6) are mechanically tied with the steel frame (5) and connected to the steel reinforcement(2) in the binding area between decorative surface layer (4) and foaming cement (1); and the expansion joints (7) and fixation holes (8) may be embedded in said foaming cement.

As FIG. 6-2 shows, Application 2 is another decoration example of this invention: a stairway handrail is roughly shaped by the steel frame(5); reinforcement ribs (6) are embedded in foaming cement (1); decorative surface layer (4) strengthened with tension-resistant material (3) is coated on the surface; and steel reinforcement (2) is set in the binding area between foaming cement (1) and decorative surface layer (4). All these technical features work together to form a fire-proof, decorative stairway handrail.

Figure 7:
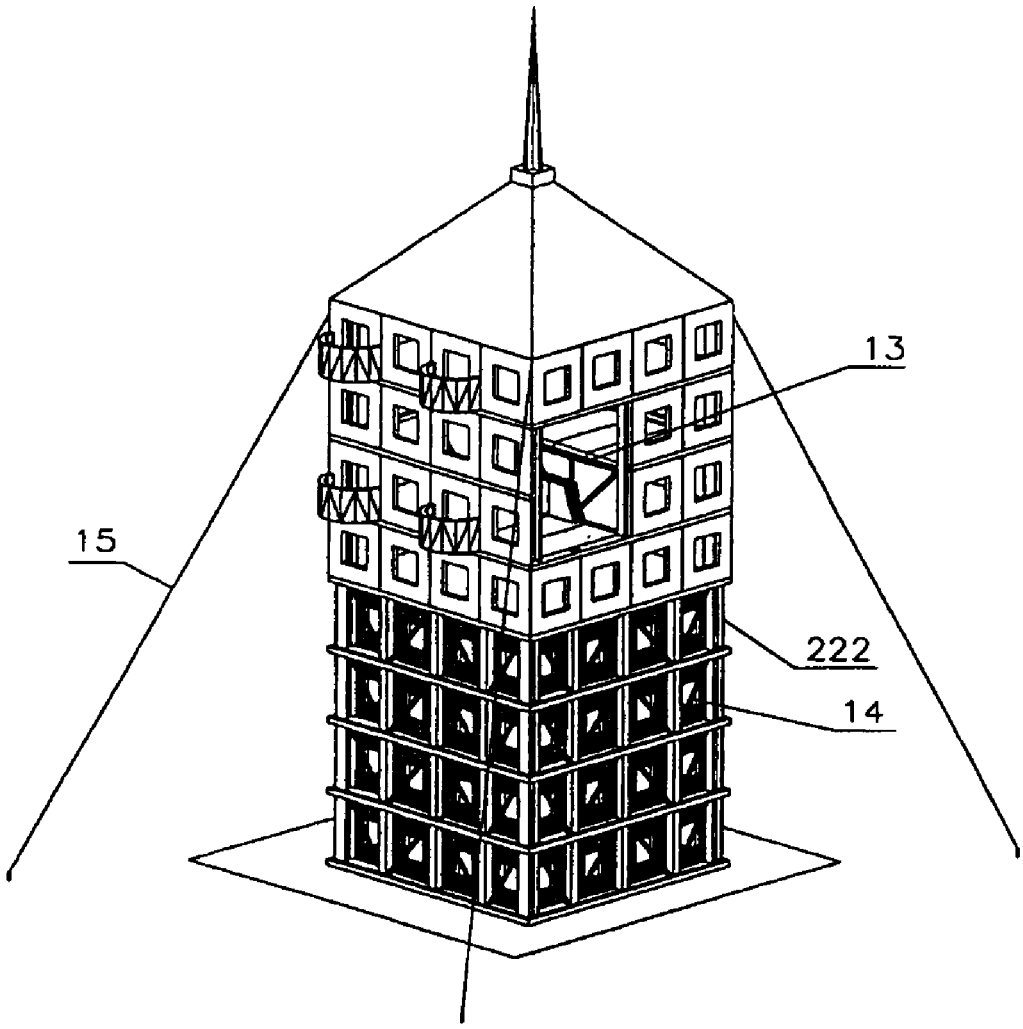
FIG. 7 is the schematic diagram of steel structure for building renovation method of this invention.

As FIGS. 1 and 7 show, the steel structure construction method of this invention for old building renovation uses lightweight steel structure being capable to utilize the old solid-concrete foundation of existing buildings when increasing stories or altering the interior structure thereof by the method with large truss fender structure (13) plus steel columniation (222) outside. According to the calculation based on the weight of existing building and the load on its foundation, a corresponding floor of the old building is put down each time as a floor is added on top of it. A, B or C-type truss fender structure can be used as partition walls and A, B or C-type fender structure can be used as exterior walls. Together with assembled interior partition walls (66), shaped steel columns (223), floor slabs (333), structural decoration (44) and ceilings (555) therewith they provide an ideal method for the reconstruction. With the new building going up, the old one is demolished and reconstructed from top down. Thus, the general form of the old building is replaced entirely while the temporary supports (14) and cables (15) may be set during the construction.

INDUSTRIAL APPLICABILITY

The construction of this invention is short in time while the design and operation thereof are easy to be standardized and industrialized. It has all the advantages of heat insulation, load-carrying decoration, fire resistance and proof, water proof and energy conservation. In addition, the overall costs become lower and room space expands. Because of its wide span, room can be rearranged in diverse manners with assembled partition wallboards and thus it is especially suitable for projects of rapid real estate development, urban reconstruction and urban-rural residential development as well. Good in earthquake resistance, the lightweight fender structures can benefit constructions in earthquake-prone regions and be a best choice for temporary houses in alleviating sufferings among disaster-stricken areas. When manufactured as industrialized production, it can be rendered as a highly integrated building with most of the construction works being finished in the factories. Heating facilities, air-conditioning, acoustic effects, kitchens, bathrooms, sports-rooms, exterior and interior decorations or other parts all can be done at one step in the factory and be assembled or installed on site as semi-products. The total construction costs are, therefore, reduced.

I claim:

1. A building fender structure comprising a first board and a second board matching the first board, both the first board and the second board having a cement body made of foaming cement, reinforcement ribs embedded in the cement body, and a cement surface layer over an outer surface of the cement body of the first board and the second board;

wherein a shaped steel frame is positioned between the first board and the second board with an inner surface of the first board facing an inner surface of the second board; the first board and the second board have expansion joints and fixation holes in their cement body and are connected to the shaped steel frame through the expansion joints; and wherein the foaming cement is formed from a mixture containing 10–70% dicalcium silicate, 10–70% anhydrous calcium sulphoaluminate, 10–70% sulphate dihydrate, 0–90% tricalcium silicate and 10–50% water, 1–10% foaming agent and 1–10% modifying additives.

2. The building fender structure of claim 1, wherein the cement surface layer is strengthened by a tension-resistant material.

3. The building fender structure of claim 1, wherein steel reinforcements are placed in a conjunction area between the cement surface layer and the cement body of the first board and the second board.

4. The building fender structure of claim 1, wherein the foaming cement is added with a predetermined amount of fiber or organic resin to increase its tenacity.

5. The building fender structure of claim 1, wherein the cement surface layer is formed of a surface layer of given elasticity.

6. The building fender structure of claim 1, wherein the cement surface layer is made into different patterns and shapes.

7. The building fender structure of claim 1, wherein the reinforcement ribs are steel girders, or small-sized shaped steels, or small small-sized shaped steels with slots.

8. The building fender structure of claim 2, wherein the tension-resistant material is a wire mesh, fiber, fiber lattice, dietary fiber, or organic resin.

9. The building fender structure of claim 3, wherein the steel reinforcements are made of steel bars surrounded by a layer of cement, and the steel bars are connected to the reinforcement ribs.

10. The building fender structure of claim 1, wherein shaped steel of the shaped steel frame is made of tendons of smaller shaped girders.

11. The building fender structure of claim 1, wherein the expansion joints of the first board and the second board are connected to the shaped steel frame by bolting or riveting at the locations of the fixation holes.

12. The building fender structure of claim 1, wherein the foaming cement has a density of 150 $kg/m^3$–400 $kg/m^3$ and a thermal conductivity of 0.035–0.08 w/ink.

13. The building fender structure of claim 1, further comprising an insulation layer placed over the inner surface of the first board.

14. The building fender structure of claim 1, wherein the first board has a joint edge shaped for receiving a joint edge of another first board so as to form a connection between said first boards; the second board has a joint edge shaped for receiving a joint edge of another second board so as to form a connection between said second boards.

15. The building fender structure of claim 14, wherein a fluid sealant is applied to the connection to form a waterproof connection.

16. A building fender structure comprising a first board and a second board matching the first board, both the first board and the second board having a cement body made of foaming cement, reinforcement ribs embedded in the cement body, and a cement surface layer over an outer surface of the cement body of the first board and the second board;

wherein a wood frame is positioned between the first board and the second board with an inner surface of the first board facing an inner surface of the second board; the first board and the second board have expansion joints and fixation holes in their cement body and are connected to the wood frame through the expansion joints; and wherein the foaming cement is formed from a mixture containing 10–70% dicalcium silicate, 10–70% anhydrous calcium sulphoaluminate, 10–70% sulphate dihydrate, 0–90% tricalcium silicate and 10–50% water, 1–10% foaming agent and 1–10% modifying additives.

17. A building structural system using the building fender structure according to claim 1 as a component.

18. The building structural system of claim 17, wherein said component is walls, floor slabs, ceilings, or assembled partition wallboards.

19. The building fender structure of claim 4, wherein said fiber includes polymer fiber, glass fiber, carbon fiber or dietary fiber.

20. The building fender structure of claim 6, wherein said patterns and shapes include brick face, stone carving, tiled shape, or decorative line-arts.

* * * * *